US006231422B1

(12) United States Patent
Choi

(10) Patent No.: US 6,231,422 B1
(45) Date of Patent: May 15, 2001

(54) TOY AUTOMOBILE

(76) Inventor: Bong Kyu Choi, 26/4, 730, Choong-dong, Pucheon-shi, Kyongki-do 420-020 (KR)

( * ) Notice: Subject to any disclaimer, the term of this patent is extended or adjusted under 35 U.S.C. 154(b) by 0 days.

(21) Appl. No.: 09/574,918

(22) Filed: May 19, 2000

(30) Foreign Application Priority Data

May 21, 1999 (KR) ..... 99-8837
Mar. 15, 2000 (KR) ..... 00-7344

(51) Int. Cl.[7] ..... A63H 18/00; A63H 18/08
(52) U.S. Cl. ..... 446/444; 446/441; 446/460
(58) Field of Search ..... 446/441, 444, 446/445, 457, 460, 462

(56) References Cited

U.S. PATENT DOCUMENTS

| | | | | |
|---|---|---|---|---|
| 4,187,637 | * | 2/1980 | Nielsen | 446/444 |
| 4,200,287 | * | 4/1980 | Ryan et al. | 446/460 |
| 4,377,918 | * | 3/1983 | Zbriger | 446/444 |
| 4,443,968 | | 4/1984 | Law . | |
| 4,453,712 | * | 6/1984 | Lee | 446/460 |
| 4,755,161 | | 7/1988 | Yang . | |
| 4,881,917 | | 11/1989 | Suzuki et al. . | |
| 4,940,443 | * | 7/1990 | Hesse | 446/445 |
| 5,273,480 | * | 12/1993 | Suto | 446/456 |
| 6,062,943 | * | 5/2000 | Maleika | 446/444 |

FOREIGN PATENT DOCUMENTS

| | | | | |
|---|---|---|---|---|
| 2187108 | * | 2/1986 | (GB) | 446/444 |
| 62-70591 | | 5/1987 | (JP) . | |
| 2-58491 | | 4/1990 | (JP) . | |
| 2-94597 | | 7/1990 | (JP) . | |
| 4-42896 | | 4/1992 | (JP) . | |
| 5-82494 | | 11/1993 | (JP) . | |
| 7-22799 | | 4/1995 | (JP) . | |
| 3030086 | | 7/1996 | (JP) . | |

* cited by examiner

*Primary Examiner*—John A. Ricci
*Assistant Examiner*—Faye Francis
(74) *Attorney, Agent, or Firm*—Donald C. Feix

(57) ABSTRACT

A toy automobile is disclosed, in which when the toy automobile runs through a curved path, a roller of a bumper of the automobile is pushed back by the wall of the track, so that the toy automobile can run through the curved path by turning the front wheels to left or right, thereby preventing the automobile from being detached from the track, or from being overturned. Universal joints 15 are respectively formed on ends of the front shaft 5 to be connected to the front wheels. Shaft retainers 16 of the front wheels are respectively supported by supporting plates 17 of the automobile body 1 by means of king pins 18. A bumper 20 is installed on a front end of the automobile body 1 by utilizing a guide slot 21, a supporting pin 22 and a spring 23 so as to make the bumper 20 turnable to left and right within the limits of the guide slot 21. A pair of steering bars 24 are respectively connected to arms 26 of the shaft retainers 16 of the front wheels. Rollers 30 and 31 are installed on both ends of the bumper 20 and are installed at both sides of an intermediate portion of the automobile body 1, whereby the rollers 30 and 31 contact to the inside of the wall of a track T, and the bumper 20 is pushed back so as to steer the front wheels.

3 Claims, 6 Drawing Sheets

TOY AUTOMOBILE

BACKGROUND OF THE INVENTION

1. Field of the Invention

The present invention relates to a toy automobile. More specifically, the present invention relates to a toy automobile in which a new steering device and a new power transmitting mechanism are provided for a toy automobile, the toy automobile running along a track.

2. Description of the Prior Art

Generally, a toy automobile includes: a driving device for transmitting the power of a DC motor to the rear wheels to make the automobile run; and a steering device for turning the front wheels to left or right.

There are many kinds of steering devices for the conventional toy automobiles. Those which are remotely controlled by a wireless frequency turn their front wheels to left and right by means of an electromagnet to run in the desired direction.

However, a toy automobile which runs along a track do not use a steering device.

In the toy automobiles, some of them transmit the driving power only to the front wheels, and some others transmit the driving force only to the rear wheels. However, recently, 4-wheel driving toy automobiles are seen, in which the driving power is transmitted to the front and rear wheels.

In the conventional 4-wheel driving method as shown in FIG. 1, the driving power of a driving motor 100 is transmitted to a pinion 300 of a rear wheel shaft 200 to drive the rear wheels. Further, the rear wheel shaft 200 and a front wheel shaft 400 are provided with power transmitting gears 500 and 600 respectively, and an elongate power transmitting shaft 700 is connected between the gears 500 and 600, so that the driving power would be transmitted from the rear to the front wheels, thereby driving all the four wheels.

In the conventional automobile which runs along a track having side walls, the rollers which are installed on the bumper contact to the inner wall of the track, and therefore, the automobile body is biased. Under this condition, the wheel which contacts to the bottom of the track is subjected to a braking phenomenon, and therefore, the small electric motor which is driven by a dry cell undergoes an overload. As a result, the power consumption of the dry cell becomes excessive, and the toy automobile is liable to be detached from the track over a curved portion of the track.

Meanwhile, in the 4-wheel driving toy automobiles, the power of the driving motor is first transmitted to the rear wheels, and then, is transmitted to the front wheels. Therefore, the front wheels lag the rear wheels in the power and speed.

In other words, the driving power of the motor is distributed non-uniformly between the rear and front wheels, and therefore, when driving up a sloped face, or when running a curved path, the driving force and velocity are lowered due to the gradient and the rolling resistance. Further, the center of gravity of the toy automobile is biased to one side, and therefore, the automobile body is biased to one side during the running. In a worse case, the toy automobile may be overturned.

SUMMARY OF THE INVENTION

The present invention is intended to overcome the above described disadvantages of the conventional technique.

Therefore it is an object of the present invention to provide a power transmitting mechanism for a toy automobile, in which the driving power is uniformly transmitted to both the front and rear wheels, so that the force and speed differences would not occur, and that the center of gravity would not be biased, thereby ensuring a safe driving.

In achieving the above object, the power transmitting mechanism for a toy automobile according to the present invention is characterized in that: two driving shaft extend from a driving motor to front and rear directions to output a driving power to front and rear portions; a driving power source is installed at a center of an automobile body; and there are no biased portions in the power transmitting mechanism.

In another aspect of the present invention, in a toy automobile which runs along a track by a dry cell motor, both ends of a front wheel shaft are connected to front wheels by means of universal joints to make it possible to turn the front wheels to left and right; a front bumper is movably attached to a front end of the toy automobile by using rollers; and a bar of a steering device (installed on the bumper) is connected to arms of shaft retainers, whereby during a running through a curved path, the toy automobile is not slipped or braked owing to the steering function of the bumper, and thus the toy automobile is prevented from being overturned.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
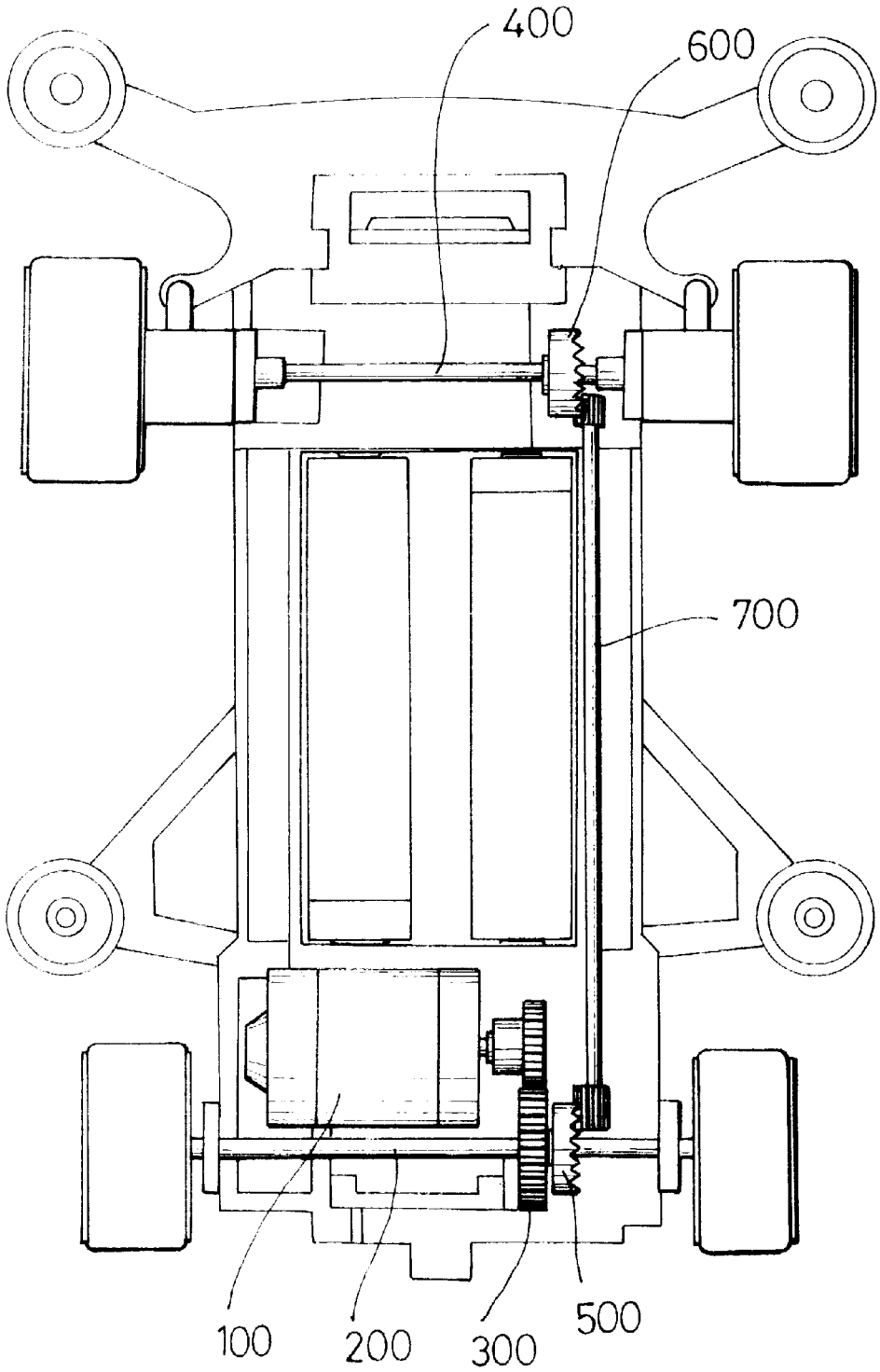
FIG. 1 illustrates the conventional power transmitting mechanism of the toy automobile.
Figure 2:
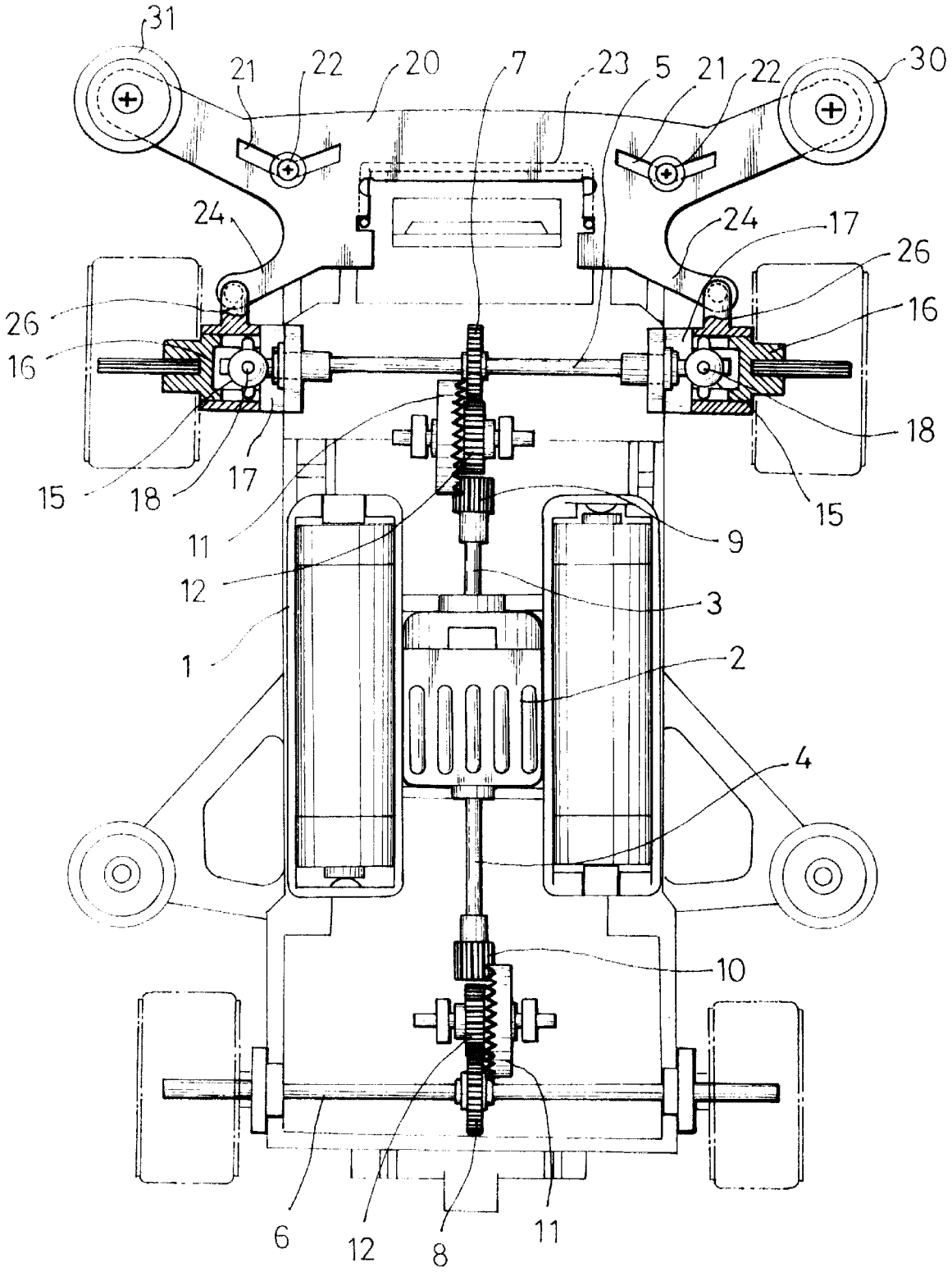
FIG. 2 illustrates the overall constitution of the toy automobile according to the present invention.
Figure 3:
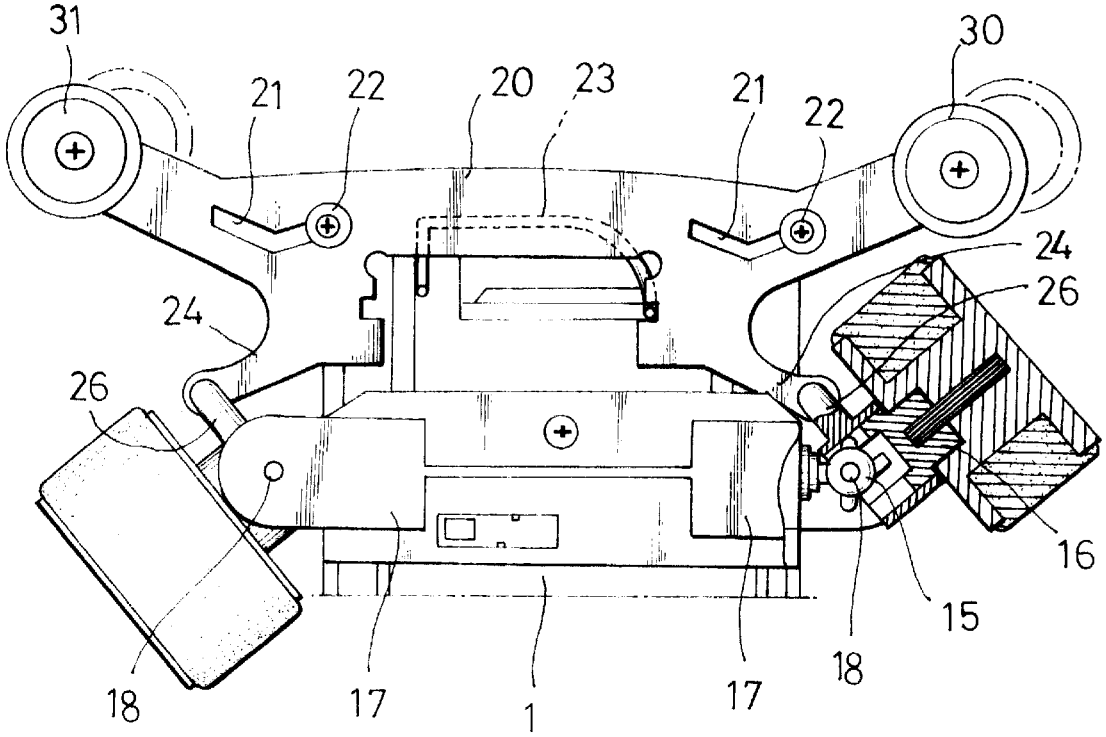
FIG. 3 illustrates an example in which a left turn is being made by the front wheel steering device.

The power driving mechanism of a toy automobile according to the present invention includes:

a driving part including: a motor 2 having two driving shafts 3 and 4 at the rear and the front and fixedly installed at the center of the bottom of an automobile body 1 in a longitudinal direction thereof; and power transmitting gears 11 and 12 respectively installed between pinions 7 and 8 of the centers of front and rear wheels 5 and 6 and pinions 9 and 10 of the driving shafts 3 and 4, so as to transmit the driving power uniformly through the driving shafts 3 and 4 to the front and rear wheels; and a steering part including: universal joints 15 respectively formed on ends of the front shaft 5 to be connected to the front wheels; shaft retainers 16 of the front wheels respectively supported by supporting plates 17 of the automobile body 1 by means of king pins 18; a bumper 20 installed on a front end of the automobile body 1 by utilizing a guide slot 21, a supporting pin 22 and a spring 23 so as to make the bumper 20 turnable to left and right within limits of the guide slot 21; a pair of steering bars 24 respectively connected to arms 26 of the shaft retainers 16 of the front wheels; and rollers 30 and 31 installed on both ends of the bumper 20 and installed at both sides of the intermediate portion of the automobile body 1, whereby the rollers 30 and 31 contact to an inner wall of a track T, and the bumper 20 is pushed back so as to steer the front wheels.

In this toy automobile, if a switch (not illustrated) is turned on, the two driving shafts 3 and 4 of the dc motor 2 simultaneously revolve. The driving power is transmitted through the power transmitting gears 11 and 12 to the front and rear wheel shafts 5 and 6, so that the toy automobile would run.

The power transmitting gears 11 and 12 consist of a crown gear and a pinion coupled together. The pinion 9 or 10 of the driving shaft is meshed with the crown gear, and the pinion 11 or 12 is meshed with the central gear 7 or 8 to drive the front and the rear wheels.

Figure 5:
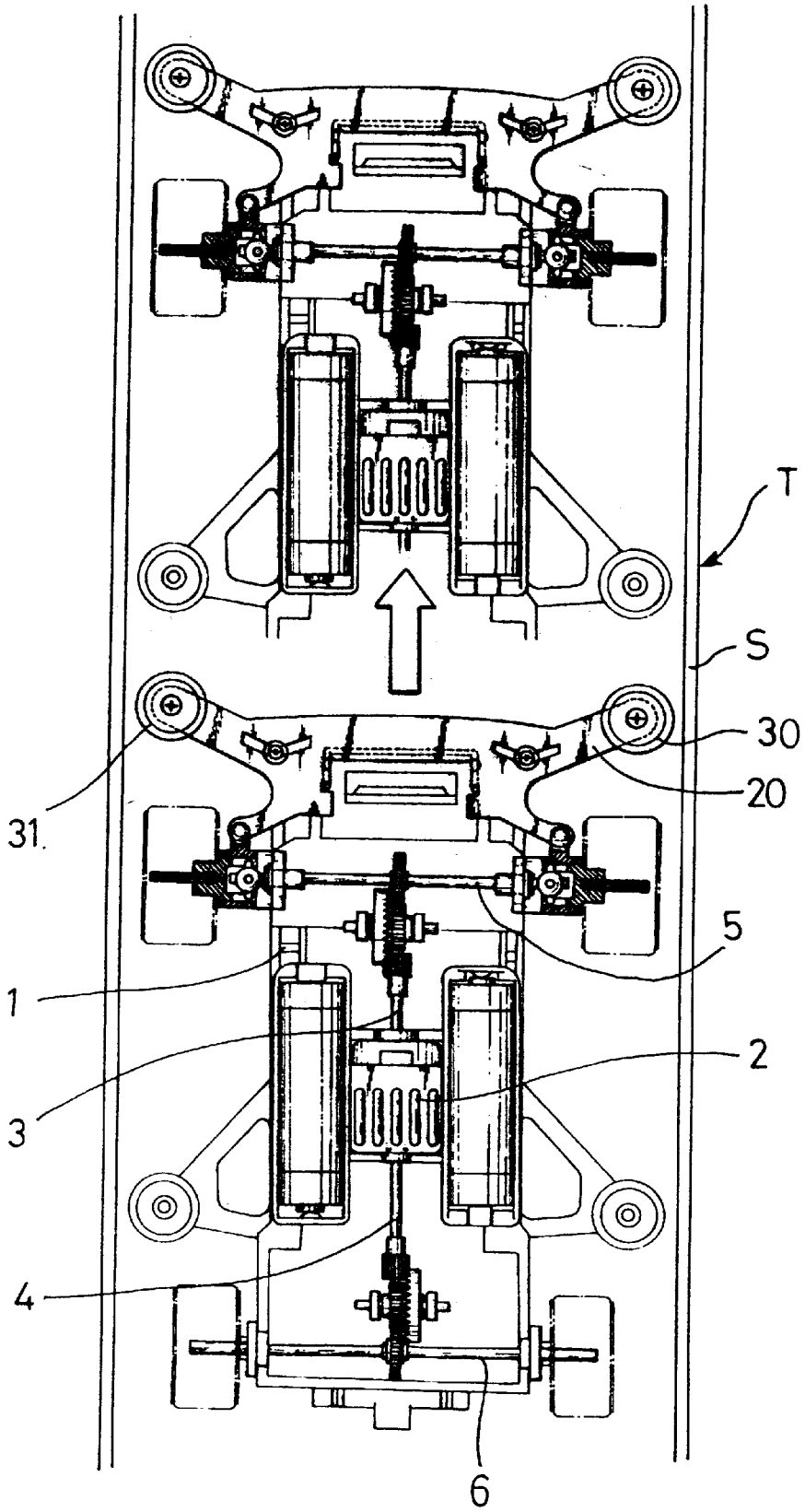
FIG. 5 illustrates a running of the toy automobile along a straight track.

As shown in FIG. 5, when running through a straight track portion, the rollers 30 and 31 of the bumper 20 are not pushed back by the inside of the wall of the track T, and therefore, the bumper 20 faces toward the exact front. Accordingly, the supporting pin 22 is positioned at the middle of the guide slot 21, and the front wheels maintain a straight posture, with the result that the toy automobile runs straightly.

Figure 6:
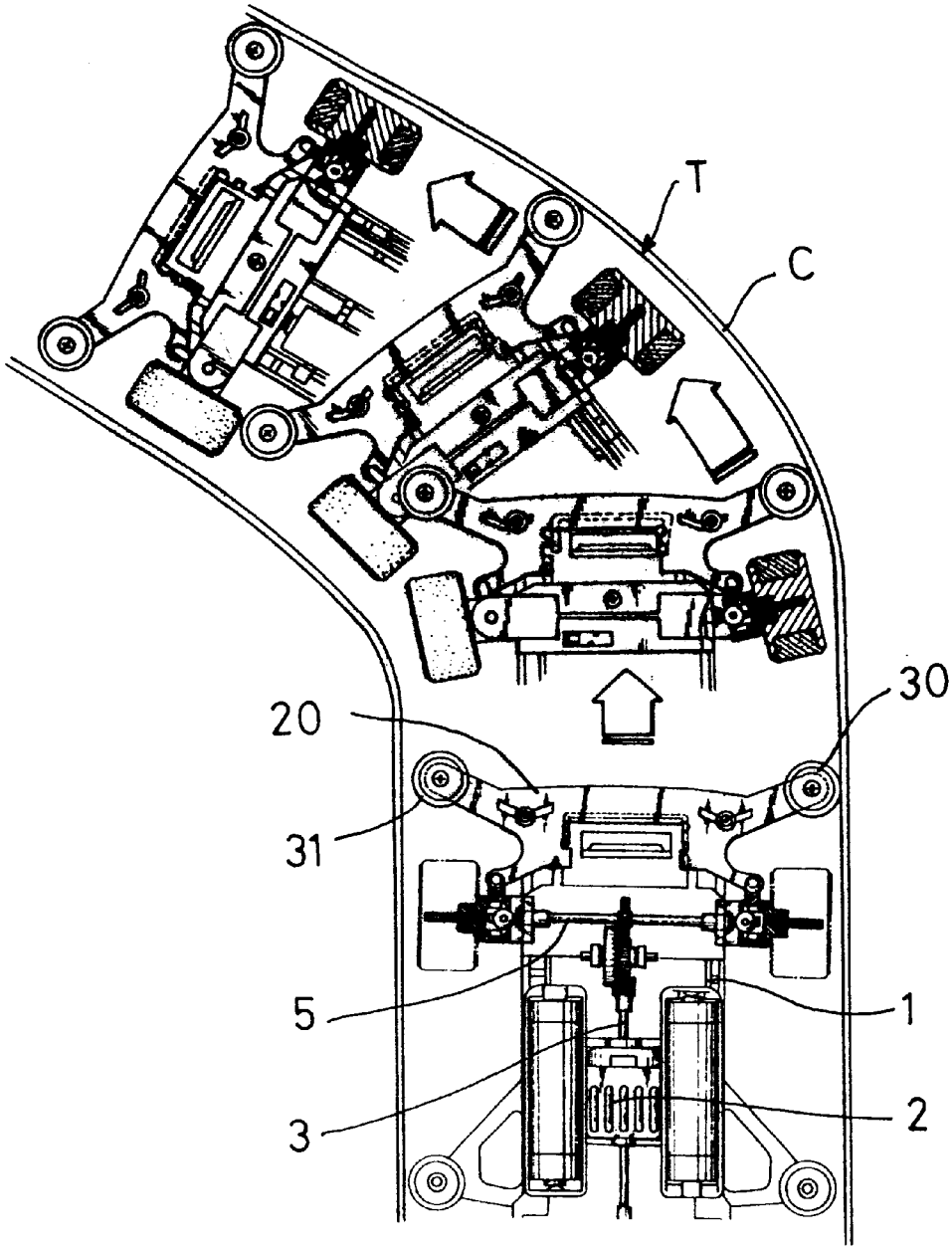
FIG. 6 illustrates a steering when the toy automobile runs along a curved path.

As shown in FIG. 6, when the toy automobile enters a left turning curve C, the right rollers are contacted to the inside of the wall of the track T. Under this condition, the front right roller is pushed back toward the left side, and at the same time, the bumper 20 also moves to the left side. This causes the steering bar 24 to pivot the arm 26 to the left, and therefore, the front wheels are turned to left, with the result that the automobile body 1 turns to the left.

If the toy automobile comes out of the curved track portion, and enters into a straight track portion, then the right roller of the bumper 20 is not pushed back by the inside of the wall of the track T, and therefore, the bumper 20 is restored to the original position owing to the elastic force of the spring 23. Accordingly, the front wheels are directed toward the front, and the toy automobile runs straightly.

Figure 4:
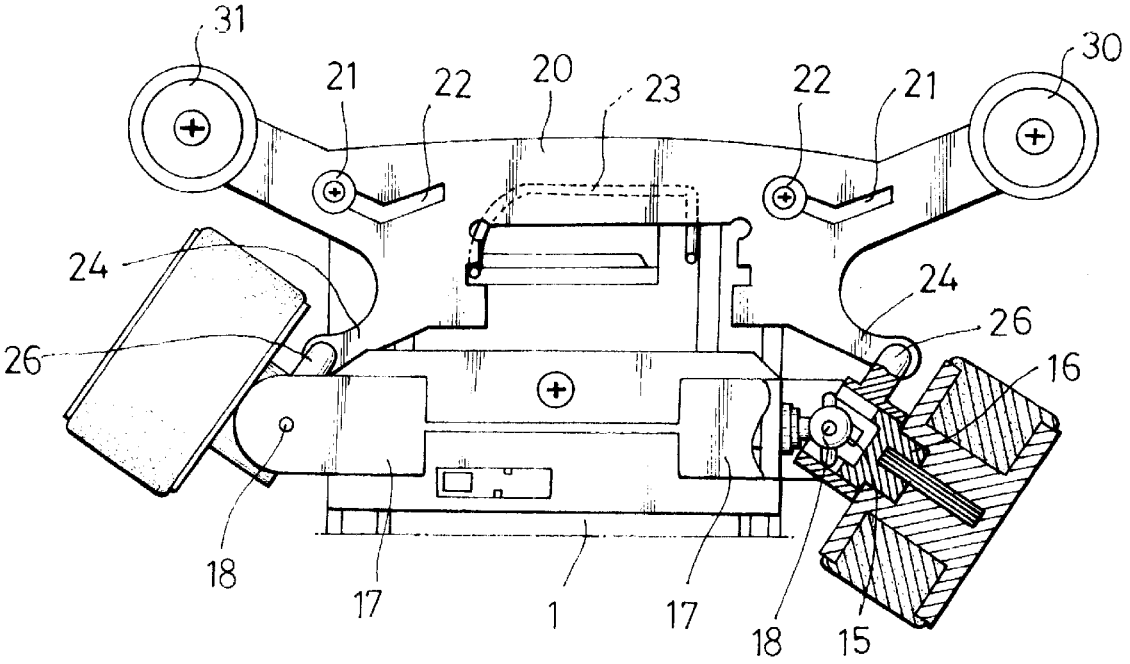
FIG. 4 illustrates an example in which a right turn is being made.

As shown in FIG. 4, if a right turning curved track portion is encountered, then the left rollers are contacted to the inside of the wall of the track T, and therefore, the bumper 20 is pushed to the right side. Accordingly, the steering bar of the bumper 20 pushes the arm to the right side, and therefore, the toy automobile runs with the front wheels turned to the right side.

If the toy automobile comes out of the right-turning curved track portion, the pushing of the rollers is released, and the bumper 20 is restored to the normal position, so that the toy automobile would run straightly.

In this manner, the toy automobile of the present invention runs along the straight and curved track portions without being externally steered, but as if it is remote-steered by an external means.

According to the present invention as described above, the driving motor and the power transmitting mechanism are installed at the center of the bottom of the toy automobile, and therefore, the center of gravity is positioned at the center of the automobile body, so that any biasing of the automobile body can be prevented during the running, and that an overturning of the automobile body can be prevented.

Further, the driving shafts are made to be extended toward the front and rear, and therefore, the driving power is transmitted uniformly to the front and rear wheels. Therefore there is no difference of force and velocity between the front and rear wheels. Further, the power transmitting mechanism is not loosely oscillated, and therefore, disorders do not occur, as well as ensuring a long life expectancy.

Further, the steering of the front wheels is realized in such a manner that the roller of the bumper is pushed back by the inside of the wall of the track. Therefore, the front wheels are turned to left or right during a left turn or right turn, and therefore, the braking phenomenon do not occur in the front wheels, while the dry cell is not subjected to an overload, as well as inhibiting the excessive consumption of the dry cell. Further, since the left turn or right turn is done by turning the front wheels to left or right, the toy automobile is not detached or overturned during the running through a curved track portion.

What is claimed is:

1. A toy automobile comprising:

a driving part comprising:

a motor 2 having two driving shafts 3 and 4 at its rear and its front and fixedly installed at a center of a bottom of an automobile body 1 in a longitudinal direction thereof; and power transmitting gears 11 and 12 respectively installed between pinions 7 and 8 of centers of front and rear wheels 5 and 6 and pinions 9 and 10 of said driving shafts 3 and 4, so as to transmit a driving power uniformly through said driving shafts 3 and 4 to said front and rear wheels; and a steering part comprising:

universal joints 15 respectively formed on ends of said front shaft 5 to be connected to said front wheels;

shaft retainers 16 of said front wheels respectively supported by supporting plates 17 of said automobile body 1 by means of king pins 18;

a bumper 20 installed on a front end of said automobile body 1 by utilizing a guide slot 21, a supporting pin 22 and a spring 23 so as to make said bumper 20 turnable to left and right within limits of said guide slot 21;

a pair of steering bars 24 respectively connected to arms 26 of said shaft retainers 16 of said front wheels; and rollers 30 and 31 installed on both ends of said bumper 20 and installed at both sides of an intermediate portion of said automobile body 1, whereby said rollers 30 and 31 contact to an inside of a wall of a track T, and said bumper 20 is pushed back so as to steer said front wheels.

2. The toy automobile as claimed in claim 1, wherein lateral motions of said bumper 20 are limited by said supporting pin 22, said supporting pin being inserted into said guide slot 21; and the spring 23 is installed between said bumper and said automobile body 1 to provide a restoring force to said bumper.

3. The toy automobile as claimed in claim 1, wherein said guide slot 21 is V-shaped.

* * * * *